United States Patent [19]

Brown et al.

[11] 4,018,272

[45] Apr. 19, 1977

[54] WELL PACKER APPARATUS

[75] Inventors: Joe R. Brown; William C. Lindsey; Phillip H. Manderscheid, all of Houston, Tex.

[73] Assignee: Brown Oil Tools, Inc., Houston, Tex.

[22] Filed: Apr. 7, 1975

[21] Appl. No.: 565,385

[52] U.S. Cl. ..... 166/119; 166/120

[51] Int. Cl.² ..... E21B 33/12

[58] Field of Search ..... 166/120, 134, 181, 182

[56] References Cited

UNITED STATES PATENTS

| | | | |
|---|---|---|---|
| 2,990,882 | 7/1961 | Brown | 166/119 |
| 3,122,205 | 2/1964 | Brown et al. | 166/120 |
| 3,265,132 | 8/1966 | Edwards, Jr. | 166/120 |
| 3,370,651 | 2/1968 | Brown | 166/134 |
| 3,391,740 | 7/1968 | Edwards, Jr. | 166/120 |
| 3,658,127 | 4/1972 | Cochran et al. | 166/120 |

*Primary Examiner*—James A. Leppink
*Attorney, Agent, or Firm*—Carlos A. Torres

[57] ABSTRACT

Disclosed is a retrievable, hydraulically set well packer which is locked in set position without need for tubing rotation and may be released from set position by shearing a retrieving link with either a straight pull on the production tubing or by the application of high pressure through the tubing. Dual, opposed cones are employed for retaining the packer slips anchored irrespective of the direction of the pressure differential acting on the packer and without need for an extra sleeve to transmit pressure induced forces to the cones. Compression seals are employed to hold the slips firmly anchored against longitudinal displacement in both directions without reliance on the presence of a pressure differential across the set packer. The seals are employed as two separate assemblies which are positioned above and below the slips to isolate a portion of the pressure induced forces from the retrieving link. A modified form of the invention employs the dual cone, dual seal design on a packer having multiple flow passages.

22 Claims, 11 Drawing Figures

WELL PACKER APPARATUS

BACKGROUND OF THE INVENTION

The present invention relates to well devices employed in the completion of oil and gas wells. More specifically, the present invention relates to a well packer which is retrievably anchored or "set" in a subsurface location within a well casing or other well conduit. When the packer is set, metal locking dogs or "slips" and annular resilient seal elements are extended radially to respectively anchor the packer to the casing and to form a pressure-light seal between the packer body and the surrounding well conduit or casing. A production tubing string connected to the packer conducts well effluents which enter the casing below the packer to the well surface. A variety of well known techniques are employed to set the packer at the desired subsurface location. Manipulation of the tubing string or the application of fluid pressure through the tubing string are examples of two common techniques.

Retrieval of the set packer requires that the radially extended seals and slips be retracted from engagement with the casing. Conventionally, a set packer may be released from its set position by manipulating the tubing string to cause mechanical components in the packer to sever or shift to a position which permits the slips and seals to retract. Once released, the tubing string and attached packer may be withdrawn from the casing.

Manipulation of the tubing string may be difficult or impossible under certain circumstances such as when the well is severely deviated or contains an obstruction. These same conditions, as well as others, may also cause a well packer to set prematurely as it is being run into the well. When premature setting occurs, the gripping force exerted by the set packer slips and seals compounds the difficulty in manipulating or retrieving the packer and attached tubing. The same conditions which make it difficult to retrieve a packer by tubing manipulation also may make it difficult to lock the packer in set position if such locking requires rotation or other surface manipulation of the tubing.

For the foregoing reasons, and others, it is frequently desirable to set, lock and release the packer by nonrotative manipulation of the tubing string. It is customary to design packers which are released by a straight upward pull of the tubing string. Such packers usually include shear pins or other frangible devices which rupture when a sufficient shearing force is imparted through the tubing string. The shear pins must remain intact while the packer is set in its normal operating position but must be capable of rupturing when a predetermined retrieving force is exerted on the tubing string.

The pressure differential acting across the set packer imposes shearing forces on the release shear pins in a straight pull release packer. Accordingly, the shear pins must be of adequate strength to prevent pressure induced shearing which might inadvertently release the set packer. If the pins are too strong, however, an undesirably large upward pulling force may be required to shear the pins for retrieval of the packer. Such large pulling forces, in addition to requiring adequate surface equipment, also impose very strong tension forces on the mandrel itself requiring oversized mandrels with reduced dimension flow passages.

Since the direction of the pressure differential acting across the set packer may be exerted in either direction or may change, it is conventional in some packer designs to employ hydraulic hold-down buttons or dual opposed spreader cones to keep the packer set irrespective of the direction of the pressure differential. In conventional dual cone designs, the seal if frequently above the slips and the pressure induced upward movement of the seal is transmitted past the slips to the lower cone by a tubular mandrel telescoped over the primary mandrel. The need for two mandrels in these packer designs reduced the space available for the packer flow opening. Dual cone designs are nevertheless frequently more desirable than designs using hold-down buttons because of the increased danger of leakage present with such buttons.

Packers having dual flow passges which employ the dual opposed cone designs and a straight pull release usually require a strong primary mandrel which is strong enough to withstand very large tension forces. The need for a strong primary mandrel stems from the fact that all of the differential pressure acting on the set packer and all of the release forces employed to retrieve the packer act through only one of the two mandrels extending through the packer. For these reasons also, the retrieving shear pin required in such packers must also be relatively strong.

Moreover, the strength requirements imposed on the primary mandrel undesirably reduce the size of the flow opening which can be formed through the mandrel. For the stated reasons, hold-down buttons, even with their inherent leakage problem, have been employed more often than opposed cones in dual completion, straight pull release packers.

A variety of prior art packer designs have employed a twin seal, dual cone arrangement to remedy several of the previously noted problems. Examples of such packer designs are shown in U.S. Pat. Nos. 2,765,852; 2,990,882; 3,142,338; and 3,331,440. While these prior art packers have particular desirable features and advantages, they are undesirable in some applications because they either require rotation of the tubing to effect setting or release of the packer or they rely on a pressure differential across the set packer to keep the slips firmly set.

SUMMARY OF THE INVENTION

The well packer of the present invention may be set without tubing rotation and may be unset by a straight pull on the tubing string or, using an appropriate plugging device, by the application of fluid pressure through the tubing string. For the straight pull retrieval, a shearable retrieving link is employed to connect the anchoring and sealing assembly of the packer to the packer mandrel. The retrieving link is shearable, once the packer is set, by pressure induced movement of a piston ring which also sets the packer or by vertical movement imparted to the packer mandrel by the tubing. The packer is set at a hydraulic pressure value which is below the pressure value required to shear the retrieving link. The piston ring carries a split locking ring which holds the packer in set position after the setting pressure is relieved and without need for a pressure differential across the set packer.

The packer of the present invention employs double acting slips and twin compression seal assemblies, one above and one below the slips. By virtue of this design, a pressure differential acting upwardly against the lower seal assembly forces the lower cone spreader up to increase the gripping force of the slips and a pressure differential in the opposite direction forces the upper seal assembly downwardly against the upper cone spreader to increase the slips' gripping force. The need for a telescoping mandrel is thus eliminated so that a larger flow passage may be formed through the packer. The use of locked compression seals, rather than swab-cup type seals or other seal assemblies which rely on a pressure differential, produces good pressure seals even when there is no pressure differential acting across the set packer.

The twin seal design also makes it possible to isolate a portion of the pressure induced forces from the shearable retrieving link. Since the anchored slips provide direct resistance to cone movement, the forces resulting from the pressure differential acting across only the cross-sectional area of the mandrel are effective on the retrieving link. By contrast, in single seal assembly designs where the seal is above the slips and the pressure is highest below the set packer, the forces resulting from the pressure differential acting across the entire cross-sectional area of the casing, less that of the tubing bore, tend to sever the retrieving link. Since much smaller pressure induced shearing forces are exerted with the twin seal design, the strength of the shear pins or retrieving link may be reduced and the upward pull required on the tubing string to shear the link for retrieval of the packer may also be reduced.

In a dual packer, the twin seal design significantly reduces the tension forces exerted on the mandrels and the retrieving link so that the dual opposed cone design may be employed. In the dual packer of the present invention, both mandrels are connected to the packer head and to the retrieving link so that either of the tubing strings connected into the packer may be used to retrieve the packer. The two mandrels thus share the pressure induced tension forces so that the need for a strong primary mandrel is eliminated. As a result, relatively large flow openings may be provided in both mandrels.

Hydraulic pressure applied through a port in the mandrel to an expansion chamber in the well packer causes relative movement between the components in the anchoring and sealing assembly of the packer to effect radial expansion of the slips and seals. A split ring covers the port to prevent debris from entering the chamber when the packer is being run into the well and after the packer is set. The hydraulic setting pressure moves the split ring away from the port to provide pressure access to the chamber.

The piston sleeve, which is temporarily fixed relative to the mandrel by the split locking ring, is responsive to the application of a sufficiently high pressure after the packer is set to sever the retrieving link. This action disengages the split locking ring and releases the assembly from its set position by permitting components in the anchoring and sealing assembly to shift relative to the stationary mandrel.

When the retrieving link is severed by a straight pull of the tubing string and attached mandrel, the locking ring remains engaged and the shearing of the retrieving link permits mandrel movement relative to the stationary anchoring and sealing assembly which in turn releases the assembly from its set position.

Other features, objects and advantages of the invention will become more readily apparent from the accompanying drawings, specification and claims.

DESCRIPTION OF THE ILLUSTRATED EMBODIMENT

Figure 1:
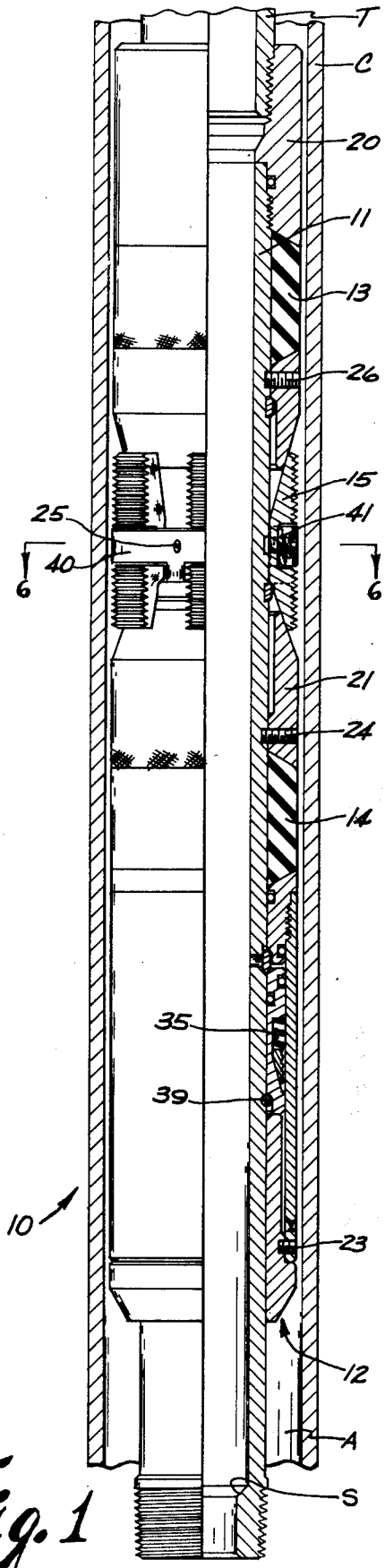
FIG. 1 is an elevation, partially in vertical section, illustrating the well packer of the present invention in its unset position.

The well packer of the present invention, indicated generally at 10, is illustrated in FIG. 1 as it appears when being run into the well through a surrounding well conduit or casing C. The packer includes a central mandrel 11 which supports an anchoring and sealing assembly indicated generally at 12. The mandrel 11 is connected to a production tubing string T which extends to the well surface.

Figure 2:
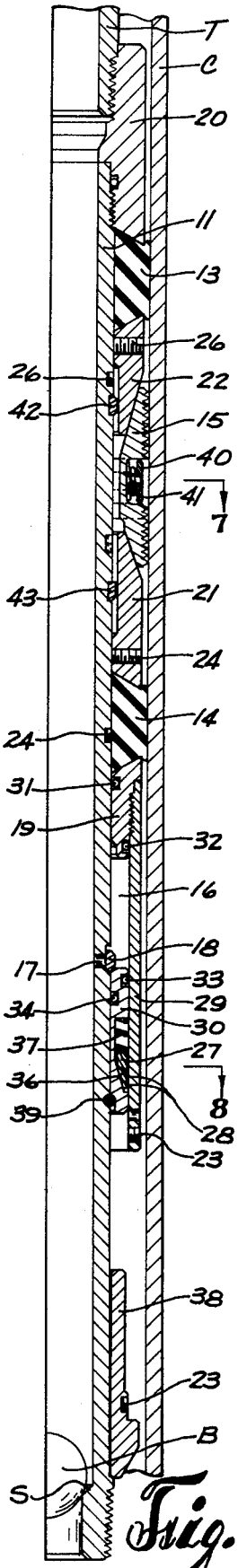
FIG. 2 is a vertical, quarter sectional view illustrating the packer in set position.

Included in the assembly 12 are compression seal elements 13 and 14 and a plurality of slip elements 15. When the packer 10 is set, as illustrated in FIG. 2, the seals 13 and 14 are compressed axially causing them to expand radially to seal the annular area A between the packer body and the casing C, and the slip elements 15 anchor the packer to the casing. The compression seal elements 13 and 14 may be any suitable seal means which are locked in to provide a pressure tight seal between the packer body and the casing without reliance on a pressure differential across the set packer.

With reference to FIG. 2, the packer 10 is set by the application of fluid pressure through the tubing T to an expansion chamber 16. The pressure is communicated from the tubing to the chamber 16 through a mandrel port 17 which is covered by a resilient metal snap ring 18. The ring 18 is spring biased radially inwardly into an annular recess formed on the mandrel. The ring 18 functions as an upper retaining member and also resiliently covers the port 17 to prevent debris from entering the chamber. Thus, the ring does not form a pressure tight seal over the port opening so that the pressure of the hydraulic fluid used to set the packer may be effectively transmitted past the ring into the chamber 16.

Setting pressure applied to the chamber 16 forces an annular piston ring 19 upwardly over the mandrel 11 toward a retaining end piece 20 which is threadedly fixed to the upper end of the mandrel. This movement compresses the seals 13 and 14 and moves them into sealing engagement with the casing C. Movement of the piston ring 19 toward the end piece 20 also acts through the seal 14 to force a lower cone spreader element 21 toward an upper cone spreader element 22. As the two cones 21 and 22 approach each other, they wedge the intermediate slip elements 15 outwardly into anchoring engagement with the casing C.

Once set, the packer 10 is firmly anchored to the casing C to prevent either up or down movement of the packer and attached tubing T. The dual cone configuration holds the packer in place irrespective of the direction of the pressure differential acting on the packer. The upper and lower seals 13 and 14 form a seal between the mandrel and the casing to prevent fluid flow in the annular area A. The seals also isolate the slip elements and thus function to prevent debris in the annulus from accumulating about the slip and cone assembly.

During the described setting procedure, shear pins 23, 24, 25 and 26 sever in the stated order to permit relative movement of the pinned components as required to expand the slips and seals. The pins are employed to prevent inadvertent setting of the packer while it is being run into the casing before the desired subsurface location is reached.

The packer is held in the set position illustrated in FIG. 2 by a split, annular lock ring 27 which has a wedge shaped cross-section. Circumferential gripping teeth 28 formed along the outer surface of the ring 27 anchor into a surrounding tubular housing 29 to prevent the attached piston ring 19 from returning to its original unset position. The housing 29, a lower piston sleeve 30, the mandrel 11 and the piston ring 19 cooperate with annular, resilient O-ring seals 31, 32, 33, and 34 to form the expansion chamber 16.

Figure 8:
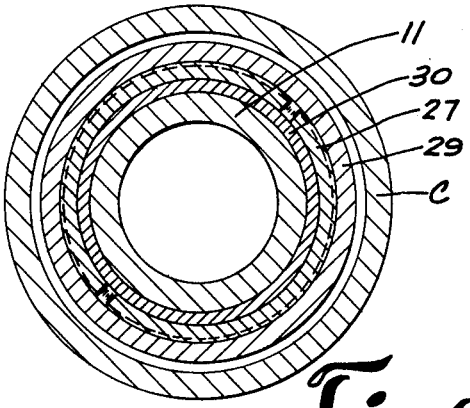
FIG. 8 is a horizontal cross-sectional view taken along the line of 8—8 of FIG. 2.

Referring jointly to FIGS. 2 and 8, it may be seen that the piston sleeve 30 is provided with an annular recess 35 which carried the split lock ring 27. As the housing 29 attempts to move downwardly relative to the sleeve 30, a tapered surface 36 on the sleeve wedges the ring 27 into tight gripping engagement with the surrounding housing. A spring element 37 resiliently biases the ring 22 down into its wedging position between the inclined surfaces 36 and the housing 29.

SETTING THE PACKER

When the packer 10 has been lowered to a desired subsurface location within the casing C, a ball B is pumped down through the tubing string T into sealing engagement with a seat S formed at the lower end of the mandrel 11. Once the ball B has seated, the pressure in the tubing string T increases in the expansion chamber 16 to drive the piston 19 upwardly relative to the lower sleeve ring 30. This upward movement serves the shear pin 23 which connects the housing 29 to a lower tubular retaining piece 39. Once the pin 23 is sheared, the retaining member 38 falls downwardly into the position illustrated in FIG. 2.

Upward movement of the piston sleeve 30 is prevented by the split ring 18 while downward movement of the piston sleeve is prevented by a circumferential, shearable split ring or retrieving link 39. As the housing 29 moves upwardly over the piston sleeve 30, the locking ring 27 is urged upwardly against the spring 37 out of its wedging position to produce a ratchet-like action which permits the upward movement of the housing 29. Reverse movement of the housing relative to the sleeve 30 is prevented by the ring 27 which is moved downwardly into its wedging position by any such reverse movement.

After the pin 23 severs, the upward movement of the piston ring 19 compresses the seal 14 which in turn urges the lower cone element 21 upwardly causing the shear pin 24 to sever. This frees the lower cone 21 for upward movement which in turn forces the slips 15 outwardly. The slips 15 are held in a floating assembly by a slip mounting ring 40. The assembly is temporarily secured relative to the mandrel 11 by the shear pins 25. When the cone 21 moves upwardly relative to the slip assembly, the resulting force exerted on the slip elements 15 forces the shear pins 25 to sever and causes the slip assembly to be driven radially outwardly into anchoring engagement with the surrounding well casing C. Once the slips are anchored, the forces exerted by the setting fluid cause the mandrel 11 to move downwardly relative to the slips. This motion pulls the upper cone into firm engagement with the slips 15. Continued downward movement of the mandrel after the upper cone 22 engages the slips 15 severs the shear pin 26 and moves the end piece 10 toward the cone 22 to radially expand the seal 13. This downward movement of the mandrel is permitted by either stretching the tubing T or moving it downwardly from the well surface. While the shear pins 24, 25 and 26 have been described as sequentially shearing in that order, the actual shearing occurs almost simultaneously.

Setting pressure is released when the components of the well packer 10 have been moved into the relative positions illustrated in FIG. 2. Once such pressure is relieved, the normal resiliency of the seals 13 and 14 tends to move the lower piston head 19 downwardly along the mandrel 11. This downward movement is prevented by operation of the locking cone 27 so that the packer remains set.

PRESSURE RETRIEVAL OF THE SET PACKER

If, during the setting or running in procedure, the well packer should prematurely anchor to the surrounding well casing, it may be released by merely supplying sufficient pressure to cause the element 39 to sever permitting the piston sleeve 30 to move downwardly. This is accomplished without any movement of the tubing T. Complete movement of the elements to their unset position usually requires that the tubing string T be raised which in turn draws an annular split ring 42 on the mandrel 11 into engagement with the upper cone 22. Further upward movement withdraws the cone 22 from under the slips 15. Continued upward pull draws a second annular slip ring 43 into engagement with the lower portion of the slip elements 15 to pull such elements off of the lower cone 21. Helical springs 41 positioned between the slip mounting ring 40 and each slip element 15 return the slip elements to a normally retracted position out of engagement with the surrounding casing wall once the cones 21 and 22 have been returned to the position illustrated in FIG. 1. The normal resiliency of the seals 13 and 14 returns them to their retracted position. The described procedure thus permits the seals and slip elements to return to their normally retracted position so that the well packer 10 may be completely withdrawn from the well casing.

Although the described pressure retrieving release of the well packer is considered to be an emergency measure, it may be desirable under some circumstances to retrieve the well packer under normal circumstances using the pressure release. Following the setting of the packer or retrieval of the packer through the application of well pressure, the ball B is returned to the surface by any conventional procedure so that well fluids may flow freely through the tubing T.

STRAIGHT PULL RELEASE OF THE WELL PACKER

Figure 3:
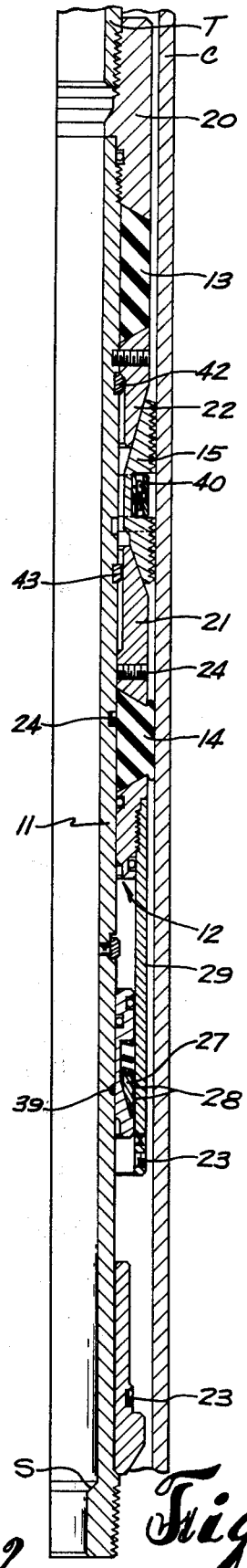
FIG. 3 is a vertical, quarter sectional view illustrating the packer in partially unset position.

FIG. 3 of the drawings illustrate the well packer 10 as it is being released from its set position by an upward pull exerted on the tubing string T. The upward pull is transmitted through the mandrel 11 to the outer assembly 12 through the retrieving link 39. When a sufficient upward pull is exerted on the tubing, the link 39 severs permitting the mandrel to be raised upwardly relative to the anchored slip segments 15. This upward movement engages the lock ring 42 with the upper cone 22 which in turn pulls the cone out from under the set slips. At this point, the components of the assembly are in the positions illustrated in FIG. 3.

Figure 4:
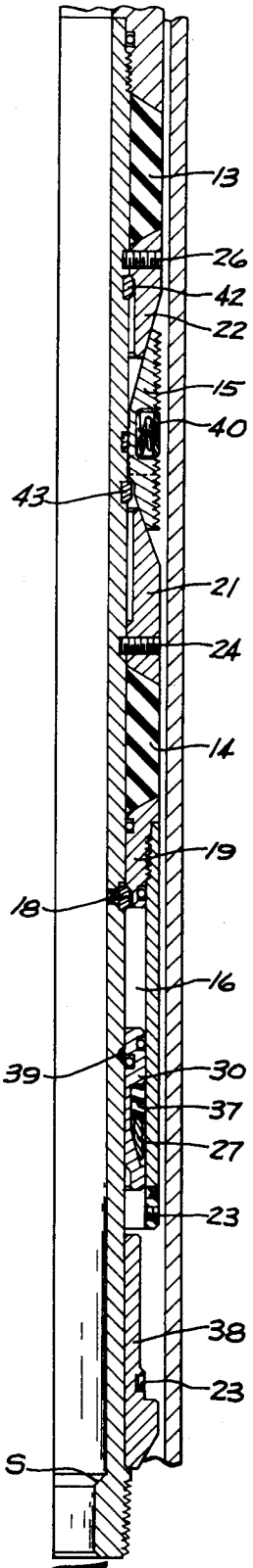
FIG. 4 is a vertical quarter sectional view illustrating the packer in fully unset position.
Figure 5:
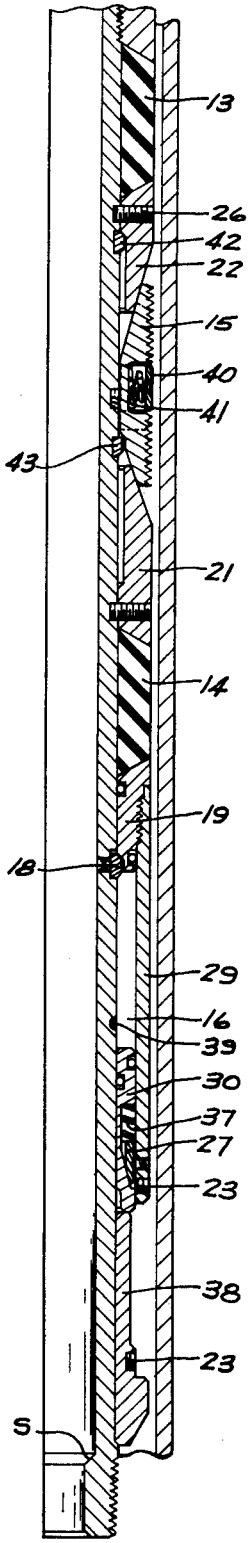
FIG. 5 is a vertical quarter sectional view illustrating the packer being withdrawn upwardly through the well as it is being retrieved.
Figure 6:
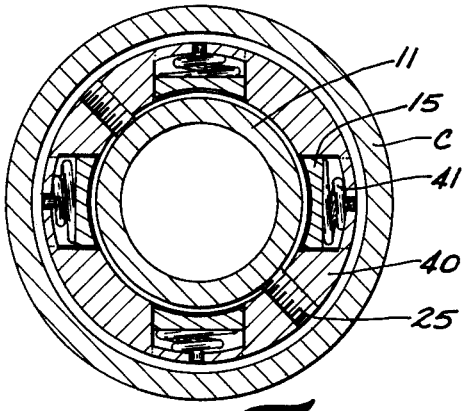
FIG. 6 is a horizontal cross-sectional view taken along the line 6—6 of FIG. 1.
Figure 7:
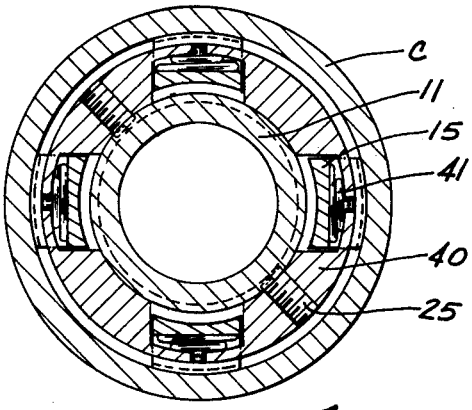
FIG. 7 is a horizontal cross-sectional view taken along the line 7—7 of FIG. 2.

FIG. 4 illustrates the well packer as it appears following continued upward movement of the tubing T which pulls the split ring 43 into engagement with the slips 15 to pull the slips off of the lower cone element 21. Once the cones 21 and 22 have been spread apart and the slip elements 15 have been retracted, the components of the outer assembly 12 move into the fully retracted position illustrated in FIG. 5. Thereafter, the well packer 10 may be withdrawn to the well surface.

DUAL STRING WELL PACKER

Figure 9:
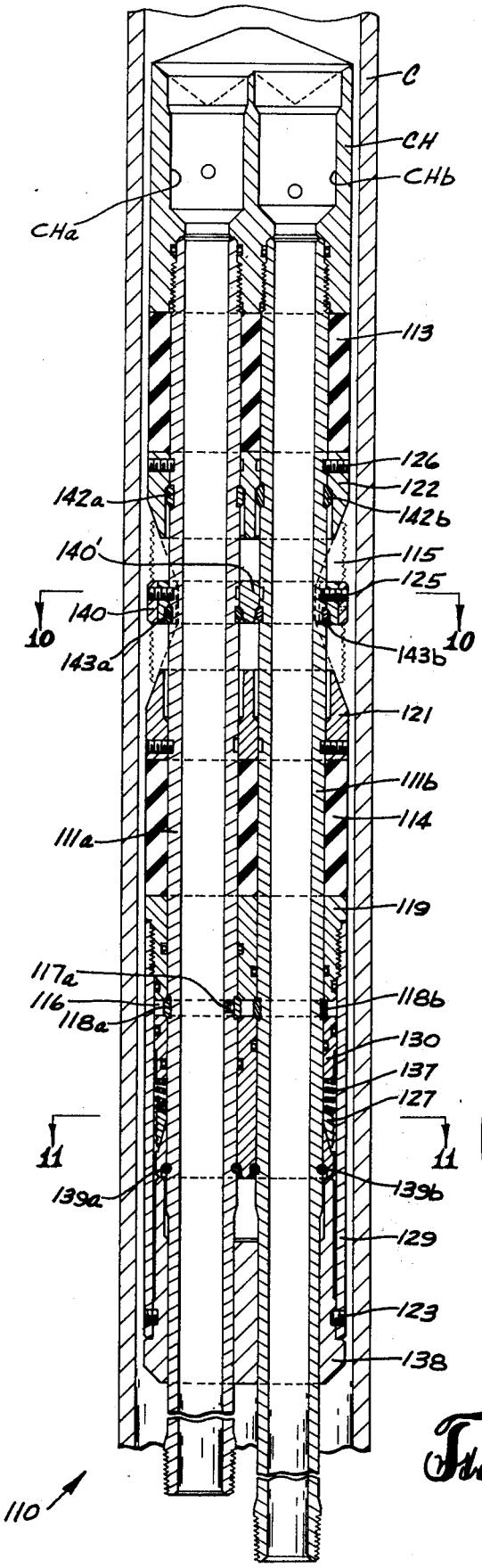
FIG. 9 is a longitudinal sectional view of a second embodiment of the invention.
Figure 10:
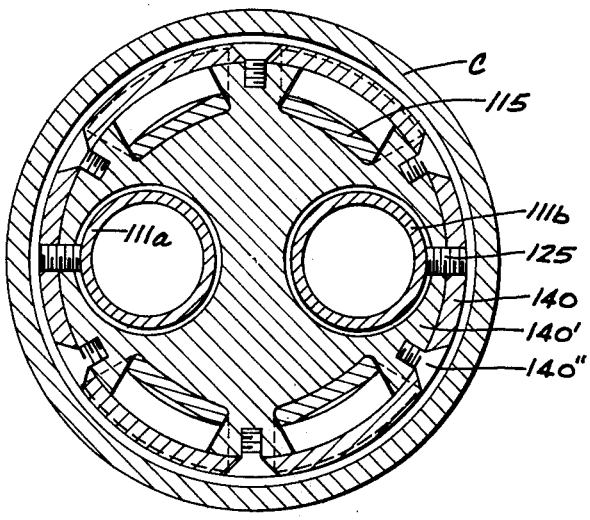
FIG. 10 is a transverse sectional view taken on line 10—10 of FIG. 9.
Figure 11:
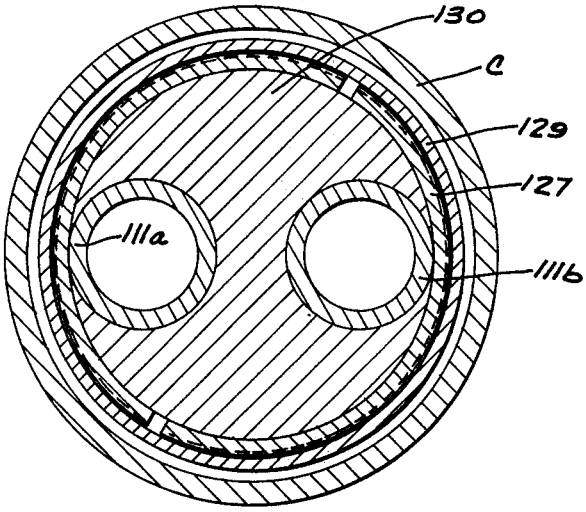
FIG. 11 is a transverse sectional view taken on line 11—11 of FIG. 9.

FIGS. 9 through 11 illustrate a modified form of the invention, indicated generally at 110 in FIG. 9, employed for establishing fluid connection between the surface and two separate subsurface locations. Unless otherwise noted, components of the well packer 110 are substantially similar in function and operation to those of corresponding components of the invention 10 and are identified by reference characters which are higher by 100 than those for corresponding components in the well packer 10. The subscript *a* is employed to identify components associated with one of the flow passages and the subscript *b* is employed with the same reference number to identify the same components associated with the second flow passage in the well packer 110.

The well packer 110 includes a conventional, dual connecting head CH with openings CH*a* and CH*b*. The well packer is releasably connected through opening CH*a* to a tubing string (not illustrated) by which the assembly is lowered into the well bore. Setting of the packer 110 is effected in the manner previously described for the packer 10 by the application of fluid pressure through the tubing string employed to lower the well packer into place. The fluid pressure acts through radial bore 117*a* in the mandrel 111*a* to expand chamber 116.

Components 113, 114, 119, 121, 122, 130, 138 and 140 are constructed in the form of cylindrical bodies having parallel openings extending longitudinally for receiving the mandrel 111*a* and 111*b*. A ring 140 secured to the body 140' by screws 140'' holds the slips 115 in position. The ring 118*b* cooperates with the ring 118*a* to form an upper stop for the piston ring 130. Once the packer is set, a second tubing string (not illustrated) is lowered through the casing and connected into the free opening CH*b* in the connecting head CH. Production from two zones may then be initiated in a customary manner. The construction and operation of the assembly 110 is analogous to and will be understood from the previous description of the construction and operation of the well packer 10.

Retrieval of the packer 110 from its set position is effected by a straight upwardly directed pull on either of the tubing strings extending to the surface to shear the retrieving links 139*a* and 139*b*. As with the packer 10, the links 139*a* and 139*b* can also be severed by the application of high hydraulic pressure with a setting plug or ball (not illustrated) suitably placed below the port 117*a* for plugging the flow passage of mandrel 111*a*.

The twin seal design in the packers 10 and 110 functions such that only that portion of the force resulting from the pressure differential across the cross-sectional area of the mandrel acts against the shear links 39 in the packer 10 and 139*a* and 139*b* in the packer 110. The force from the pressure differential across the packer seals is not transmitted to the retrieving link since it is applied directly to the spreader cones. For example, with specific referenece to FIG. 2, it may be noted that if the pressure below the seal 14 is greater than that above the seal 13, the pressure differential tends to force the seal 14 upwardly. This upward force is transmitted to the cone 21 which in turn transmits the force to the slips 15. This portion of the pressure induced force is not exerted against the mandrel 11 and accordingly is not exerted against the retrieving link 39. If the seal 14 were omitted however, the pressure differential would apply an upward force on the seal 13 which in turn would exert an upward force on the mandrel 11. In a straight pull release packer, this upward force would have to be resisted by the same device that must be severed to retrieve the packer. As a result, the use of only a single seal in a straight pull release packer requires a stronger shear pin or retrieving link than that required with the dual seal design of the present invention.

While hydraulic setting is employed in the preferred form of the present invention, it will be appreciated that the advantages of the dual seal design may also be applied to mechanically set packers. Other modifications of the present invention will suggest themselves to those having ordinary skill in the art. By way of example, rather than limitation, the dual seal, opposed cone design may be employed in any multiple bore packers and is not limited to the single and double bore examples specifically described herein.

The foregoing disclosure and description of the invention is illustrated and explanatory thereof, and various changes in the size, shape and materials as well as in the details of the illustrated construction may be made within the scope of the appended claims without departing from the spirit of the invention. By way of example rather than limitation, the seals 13 and 14 may be omitted and, with other obvious minor changes, the device 10 may be employed to function as an anchor to hold or position a liner or other well device or assembly within the well.

We claim:

1. A retrievable well device which may be set to anchor to a surrounding well conduit at a subsurface location comprising:

a. a mandrel assembly;

b. an anchoring assembly carried on said mandrel assembly;

c. friction gripping elements included in the anchoring assembly, said gripping elements being expandable radially into a set position to anchor said well device to said surrounding well conduit;

d. setting means including means movable in a first longitudinal direction relative to said mandrel assembly for moving said gripping elements into said set position;

e. locking means between said mandrel assembly and said movable means permitting movement of said movable means relative to said locking means in said first direction but preventing movement of said movable means relative to said locking means in a second direction opposite to said first direction and movement of said locking means relative to said movable means in said first direction for maintaining said gripping elements in said set position;

f. said mandrel assembly, said setting means and said locking means at least partially defining an expansion chamber in communication with the interior of said mandrel assembly, said movable means and said locking means defining respective opposed axially facing pressure reaction surfaces within said chamber, said movable means being so movable in said first direction responsive to the application of fluid pressure above a first limit from said mandrel assembly to said expansion chamber to move said gripping elements into said set position; and g. linking means interconnecting said locking means and said mandrel assembly for preventing movement of said locking means relative to said mandrel assembly in said second direction and movement of said mandrel assembly relative to said locking means in said first direction upon application of fluid pressure below a second limit, greater than said first limit, through said mandrel assembly to said chamber, and releasable upon application of fluid pressure above said second limit to said chamber to permit such relative movement of said locking means and said mandrel assembly whereby said gripping elements may be retrieved from said set position.

2. A device as defined in claim 1 wherein said linking means is alternatively releasable by longitudinal movement of said mandrel assembly in said first direction.

3. A device as defined in claim 1 wherein said mandrel assembly includes a plurality of longitudinally extending flow passages for conducting fluids through said well device.

4. A device as defined in claim 1 further including resilient seal means in the anchoring assembly, said seal means being expandable radially into said set position to form a seal between said well device and said surrounding well conduit.

5. A device as defined in claim 4 wherein said anchoring assembly includes dual spreading elements disposed between said upper and lower seal means, and said spreading elements being movable longitudinally relative to each other for expanding said friction gripping elements into set position.

6. A device as defined in claim 4 wherein said mandrel assembly includes a plurality of longitudinally extending flow passages for conducting fluids through said well device.

7. A device as defined in claim 4 wherein said resilient seal means includes upper and lower annular resilient seal members disposed above and below said friction gripping elements for forming pressure seals between said mandrel assembly and said well conduit.

8. A device as defined in claim 4 wherein said setting means is further responsive to the application of fluid pressure above said first limit from said mandrel assembly for moving said seal means into said set position and wherein said locking means is further operative to maintain said seal means in said set position.

9. A device as defined in claim 2 wherein said linking means includes a severable connecting means connecting said locking means and said mandrel assembly.

10. A device as defined in claim 9 wherein said mandrel assembly includes a plurality of longitudinally extending flow passages for conducting fluids through said well device.

11. A device as defined in claim 9 wherein said resilient seal means includes upper and lower annular resilient seal members disposed above and below said friction gripping elements for forming pressure seals between said mandrel assembly and said well conduit.

12. A device as defined in claim 11 wherein said anchoring assembly includes dual spreading elements disposed between said upper and lower seal means, said spreading elements being movable longitudinally relative to each other for expanding said friction gripping elements into said set position.

13. A device as defined in claim 12 wherein said movable means includes an annular piston member defining part of said expansion chamber, and one of said pressure reaction surfaces said piston member being responsive to the application of fluid pressure above said first limit to said chamber for expanding said gripping elements and said seal means into said set position.

14. A device as defined in claim 3 wherein said movable means includes an annular piston member defining part of said expansion chamber, and one of said pressure reaction surfaces said piston member being responsive to the application of fluid pressure above said first limit to said chamber for expanding said gripping elements and said seal means into said set position.

15. A device as defined in claim 8 wherein said mandrel assembly includes a plurality of longitudinally extending flow passages for conducting fluids through said well device.

16. A device as defined in claim 14 wherein said resilient seal means includes upper and lower annular resilient seal members disposed above and below said friction gripping elements for forming pressure seals between said mandrel assembly and said well conduit.

17. A device as defined in claim 16 wherein said anchoring assembly includes dual spreading elements disposed between said upper and lower seal means, and said spreading elements being movable longitudinally relative to each other for expanding said friction gripping elements into said set position.

18. A retrievable well device carried by a tubular well conduit and adapted to be set to anchor to a surrounding well conduit at a subsurface location comprising:

a. a mandrel assembly connected with said tubular well conduit;

b. an anchoring assembly carried on said mandrel assembly;

c. friction gripping elements included in the anchoring assembly, said gripping elements being expandable radially into a set position to anchor said well device to said surrounding well conduit;

d. setting means including means movable in a first longitudinal direction relative to said mandrel assembly for moving said gripping elements into said set position;

e. locking means between said mandrel assembly and said movable means permitting movement of said movable means relative to said locking means in said first direction but preventing movement of said movable means relative to said locking means in a second direction opposite to said first direction and movement of said locking means relative to said movable means in said first direction for maintaining said gripping elements in said set position;

f. resilient compression seal means including upper and lower seal assemblies disposed above and below said friction gripping elements for forming and maintaining pressure tight seals between said mandrel assembly and said well conduit when said well device is set, said seal assemblies being of the type which maintain said pressure tight seals in the absence of a pressure differential across said set device;

g. said mandrel assembly, said setting means and said locking means at least partially defining an expansion chamber in communication with the interior of said mandrel assembly, said movable means and said locking means defining respective opposed axially facing pressure reaction surfaces within said chamber, said movable means being so movable in said first direction responsive to the application of fluid pressure above a first limit from said mandrel assembly to said expansion chamber to move said gripping elements into said set position; and h. linking means interconnecting said locking means and said mandrel assembly, said linking means including a retrieving link, for preventing movement of said locking means relative to said mandrel assembly in said second direction and movement of said mandrel assembly relative to said locking means in first direction upon application of fluid pressure below a second limit, greater than said first limit, through said mandrel assembly to said chamber, and severable upon application of fluid pressure above said second limit through said mandrel assembly to said chamber to permit release of said well device from set position by longitudinal, non-rotative movement of said tubular well conduit and said mandrel assembly in said first direction.

19. A device as defined in claim 18 wherein said mandrel assembly includes a plurality of longitudinally extending flow passages for conducting fluids through said well device.

20. A device as defined in claim 18 wherein said anchoring assembly includes dual spreading elements disposed between said upper and lower seal assemblies, said spreading elements being movable longitudinally relative to each other for expanding said friction gripping elements into said set position.

21. A device as defined in claim 20 wherein said setting means is further responsive to the application of fluid pressure above said first limit from said mandrel assembly for moving said seal means into said set position.

22. A device as defined in claim 21 wherein said setting means includes an annular piston member defining part of said expansion chamber, and one of the said pressure reaction surfaces, said piston member being responsive to the application of fluid pressure for expanding said gripping elements and said seal means into said set position.

* * * * *

UNITED STATES PATENT AND TRADEMARK OFFICE

CERTIFICATE OF CORRECTION

PATENT NO. : 4,018,272

DATED : April 19, 1977

INVENTOR(S) : Joe R. Brown; William C. Lindsey; Phillip H. Manderscheid

It is certified that error appears in the above-identified patent and that said Letters Patent are hereby corrected as shown below:

In Column 1, line 13, delete "light" and insert therefore --tight--.

In Column 2, line 7, delete "if" and insert therefore --is--.

In Column 2, line 12, delete "reduced" and insert therefor --reduces--.

In Column 2, line 17, delete "passges" and insert therefore --passages--.

In Column 5, line 56, delete "39" and insert therefore --38--.

In Column 6, line 22, delete "10" and insert therefore --20--

In Column 7, line 1, delete "the" second occurrence.

In Column 7, line 26, delete "been".

In Column 8, line 22, delete "referenece" and insert therefore --reference--

In Column 8, line 44, insert --also-- after "will".

In Column 8, line 52, delete "illustrated" and insert therefore --illustrative--.

UNITED STATES PATENT AND TRADEMARK OFFICE

CERTIFICATE OF CORRECTION

PATENT NO. : 4,018,272

DATED : April 19, 1977

INVENTOR(S) : Joe R. Brown; William C. Lindsey; Phillip H. Manderscheid

It is certified that error appears in the above-identified patent and that said Letters Patent are hereby corrected as shown below:

In the Claims

In Column 10, line 35, delete "3" and insert therefore --8--.

In Column 10, line 55, delete "and" second occurrence.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*